US006425536B2

(12) United States Patent
Namura

(10) Patent No.: US 6,425,536 B2
(45) **Date of Patent: *Jul. 30, 2002**

(54) AIR BRUSH WITH REMOVABLE AND ROTATABLE NOZZLE HEAD

(75) Inventor: William H. Namura, Portland, OR (US)

(73) Assignee: Iwata-Medea, Inc., Portland, OR (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/950,374

(22) Filed: Oct. 14, 1997

Related U.S. Application Data

(63) Continuation of application No. 08/538,811, filed on Oct. 3, 1995, now abandoned, and a continuation of application No. 08/221,018, filed on Mar. 30, 1994, now Pat. No. 5,454,517.

(51) Int. Cl.[7] ..... A62C 31/02; B05B 7/12; B05B 9/08

(52) U.S. Cl. ..... 239/390; 239/417.3; 239/530

(58) Field of Search ..... 239/390, 416.4, 239/525, 528, 417.3, 530, 416.5, 306, 346; 137/636

(56) References Cited

U.S. PATENT DOCUMENTS

| | | | | |
|---|---|---|---|---|
| 2,247,000 A | * | 6/1941 | Popoff | 239/527 X |
| 2,591,364 A | * | 4/1952 | Kurth | 239/530 X |
| 2,757,048 A | * | 7/1956 | Balmer | 239/526 X |
| 3,072,342 A | * | 1/1963 | MacFarland | 239/364 X |
| 3,780,953 A | * | 12/1973 | Malee | 239/526 |
| 4,161,289 A | * | 7/1979 | Rebold | 239/526 X |
| 4,171,097 A | | 10/1979 | Rebold | |
| 4,798,336 A | | 1/1989 | Ilott | |
| 4,925,101 A | * | 5/1990 | Konieczynski et al. | 239/526 X |
| 4,978,072 A | * | 12/1990 | Kurowski | 239/346 |
| 5,086,978 A | * | 2/1992 | Fentig | 239/525 X |
| 5,131,598 A | * | 7/1992 | Hoogeveen, Jr. | 239/223 |
| 5,346,135 A | * | 9/1994 | Vincent | 239/306 |
| 5,366,158 A | | 11/1994 | Robisch et al. | |
| 5,421,518 A | | 6/1995 | Robisch et al. | |
| 5,687,913 A | * | 11/1997 | Robisch et al. | 239/346 |

FOREIGN PATENT DOCUMENTS

| | | | | |
|---|---|---|---|---|
| JP | 4180859 | * | 6/1992 | 239/526 |

* cited by examiner

*Primary Examiner*—David A. Scherbel
*Assistant Examiner*—Davis Hwu
(74) *Attorney, Agent, or Firm*—Keith A. Cushing

(57) ABSTRACT

An air brush is shown and described including a replaceable, rotatable, nozzle head including a media port and a needle arrangement. Media contamination of the air brush is limited to the removable nozzle head, thereby making the air brush body free of media contamination. By rotatable mounting of the nozzle head, a variety of media sources are made available, ranging from gravity fed devices such as media top and side cups to suction fed devices such as media jars. The trigger arrangement of the present invention presents an actuator shaft movable longitudinally in response to trigger movement for engagement of the needle of the nozzle head. Mechanical coupling between the air brush body and nozzle head is limited to structural coupling for mounting the nozzle head and an abutment relationship between the actuator shaft and the needle. This allows rotational freedom of movement for the nozzle head relative to the body, and also ease of dismounting by simply separating the nozzle head from the air brush body. The air brush provides both a double-action and single-action trigger for broad versatility in selected modes of use. Overall, the simplified mechanical design and improved operational abilities provide an air brush of great versatility and low maintenance.

19 Claims, 2 Drawing Sheets

AIR BRUSH WITH REMOVABLE AND ROTATABLE NOZZLE HEAD

RELATED APPLICATION

This application is a Continuation of U.S. patent application Ser. No. 08/538,811 filed Oct. 3, 1995 now abandoned and Ser. No. 08/221,018 filed Mar. 30, 1994 and issued Oct. 3, 1995 as U.S. Pat. No. 5,454,517.

BACKGROUND OF THE INVENTION

This invention relates generally to media delivery apparatus, and particularly to air brush construction and media delivery systems.

An air brush is characterized by a compressed air source and a media source integrated into a handheld device. The compressed air originates from an air compressor delivering compressed air by way of an air hose to the air brush. An intricate set of passageways through the structure of the air brush, including a valve for controlling flow of compressed air, deliver the compressed air to the nozzle. Upon actuation of a spray button, a needle valve releases a flow of media near the outlet of the air brush body while concurrent therewith a source of compressed air is released by valve actuation to provide an air flow around and past the needle valve outlet. The air flow draws media from the needle valve outlet and the media is atomized as it exits the body of the air brush within the air flow. In operation, the user depresses the spray button while moving the device in a desired pattern to produce the atomized spray and desired media coverage.

Such handheld air brushes are generally complicated mechanical devices including intricate passageways for delivering media and compressed air and requiring various lever and spring assemblies responsive to actuation of the spray button to produce the desired media flow and air stream at the outlet of the air brush. Such mechanical complexity contributes to a generally expensive item requiring significant maintenance and cleaning.

Because the media flows within the body of the air brush, an air brush requires an intermediate cleaning step between use of different media or media colors. Where media is introduced into the air brush and continuing through to the nozzle outlet, the air brush structure is contaminated with each media or media color used and must be carefully cleaned before a new media or color can be used. In some air brush arrangements, a needle extends along the entire length of the air brush, the needle tip being positioned forward at the nozzle outlet to control media discharge by longitudinal movement of the needle relative to the nozzle outlet. To disassemble such air brush arrangements, the needle is withdrawn from the rear of the air brush, i.e., the tip is pulled through the entire length of the air brush structure. Because the needle tip is necessarily contaminated with media, such procedure contaminates all portions of the air brush having contact with the needle tip during withdrawal of the needle.

Air brushes are typically used in elaborate art work requiring fine control over media delivery and, in many cases, many different media or many media colors in a single project. Cleaning is particularly burdensome in such use of an air brush because the artist often must apply a great number of colors before the work is complete and for each color change an intermediate cleaning step is required.

Air brushes come in a variety of basic configurations. In one arrangement, a cup holds a reservoir of media which flows under the influence of gravity out the bottom of the cup and into the air brush structure. In other air brush arrangements, media is held in a jar positioned below the air brush with a tube extending into the body of media within the jar and communicating with media flow passageways of the air brush. As the air flow draws media from the media passageways, media is pulled from the jar and into the air brush. If an artist wishes to use both types of air brushes, the artist must have available two separate air brushes.

It would, therefore, be desirable for an air brush to be less difficult to use, less complicated in mechanical operation, less expensive, and permit more convenient switching between media or media color.

SUMMARY OF THE INVENTION

A preferred embodiment of the present invention in a first aspect is an air brush comprising a body and a nozzle head. The nozzle head provides a media port and also contains entirely the needle and nozzle arrangement to limit media contamination to the removable nozzle head. The mounting arrangement of the nozzle head relative to body further provides freedom of rotation and, thereby, support for a variety of media sources and user selected orientation during use. The air brush body includes an actuator shaft responsive to trigger movement to engage by abutment the rear end of the needle located entirely within the nozzle head. Relative position between the actuator shaft and the trigger is selectively established to govern the magnitude of media delivered in a media spray relative to a given trigger position.

The preferred embodiment of the present invention includes a body including a trigger assembly wherein the trigger assembly presents at a head mounting site an actuator shaft movable longitudinally in response to actuation of the trigger. The air brush further includes a nozzle head defining a nozzle conduit, the nozzle conduit providing a nozzle outlet. The nozzle head further includes a coupling structure removably mountable to the body at the head mounting site. The nozzle head includes a needle and spring arrangement, each residing coaxially within the nozzle conduit with the spring biasing the needle away from the nozzle outlet. An abutment end of the needle opposite the nozzle outlet is positioned relative to the actuator of the air brush body whereby the actuator may urge the needle forward toward the nozzle outlet. The nozzle head further includes a media port communicating with the nozzle conduit intermediate of the nozzle outlet and the abutment end of the needle. In accordance with one aspect of the preferred embodiment, rotational mounting of the nozzle head relative to the air brush body allows variation in media sources employed and user selection of device orientation while in use.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE PREFERRED EMBODIMENT

Figure 1:
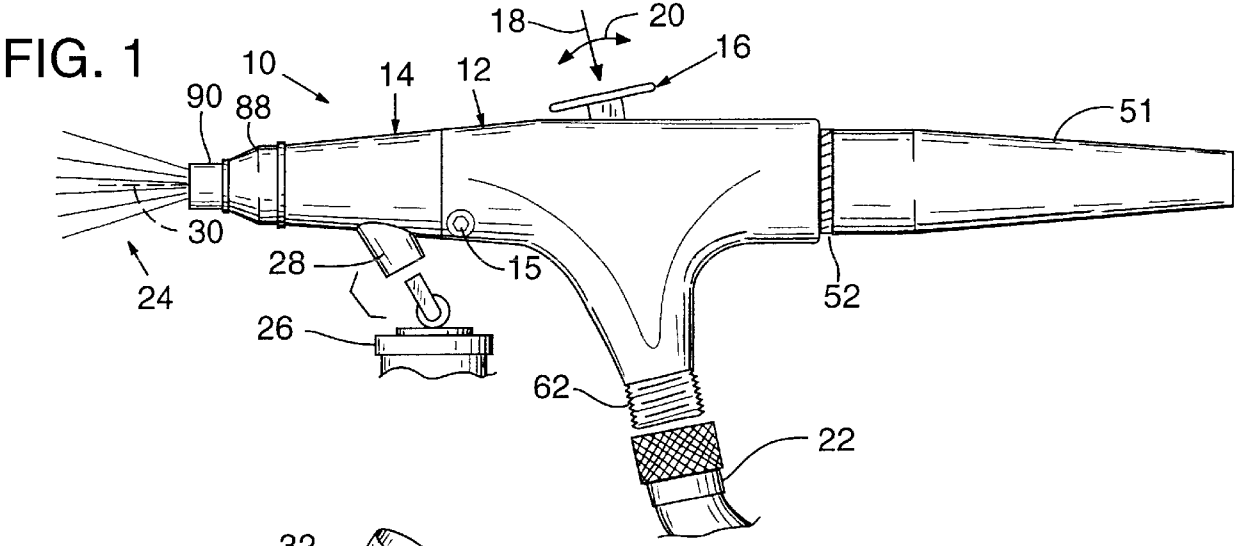
FIG. 1 is a side view of an air brush according to a preferred embodiment of the present invention in a first mode of operation.

The preferred embodiment of invention as illustrated in the drawings is an air brush 10 comprising a body 12 and a nozzle head 14. The nozzle head 14 is removably mountable, i.e., easily mounted and dismounted by the user, relative to the body portion. An allen screw 15 threadably engaging the body 12 and bearing against a portion, described more fully hereafter, of nozzle head 14 secures nozzle head 14 upon the body 12. Furthermore, and as will be discussed more fully hereafter, media contamination is limited generally to the nozzle head 14. Generally, media contamination is limited to the nozzle head 14 because media is introduced to the air brush 10 at the nozzle head 14, rather than the body 12, and because the nozzle head 14 contains entirely the needle applied to the nozzle outlet. When the nozzle head 14 is removed from body 12, body 12 is not contaminated and, therefore, requires no cleaning step. Also, because media contamination is limited to the nozzle head 14 and because nozzle head 14 is easily disassembled and serviced, the user generally enjoys reduced effort in servicing and use of air brush 10.

With reference to FIG. 1, air brush 10 is shown including a trigger 16 operable in two dimensions, i.e., a double-action trigger. More particularly, trigger 16 is spring biased to an upper or extended position and may be depressed, as indicated by direction arrow 18, to activate an air flow to the nozzle head 14. Trigger 16 may also be pivoted, as indicated by double headed arrow 20, to control a volume of media exiting air brush 10. Air brush 10 couples to an air hose 22 serving as a source of pressurized air. As may be appreciated, pressing trigger 16 selectively delivers the pressurized air to nozzle head 14 for developing a media spray 24. As will be discussed more fully hereafter, an adjustment knob 50 establishes a range of movement for the needle within nozzle head 14, thereby establishing a range of media metering available when operating trigger 16. The trigger arrangement provided under the present invention serves both a dual-action and a single-action trigger function. Thus, the user may depress trigger 16 and move trigger 16 longitudinally in a double-action fashion, or may simply adjust the knob 50 to a given position, maintain trigger 16 in a given longitudinal position, and depress trigger 16 in a single-action fashion.

Figure 2:
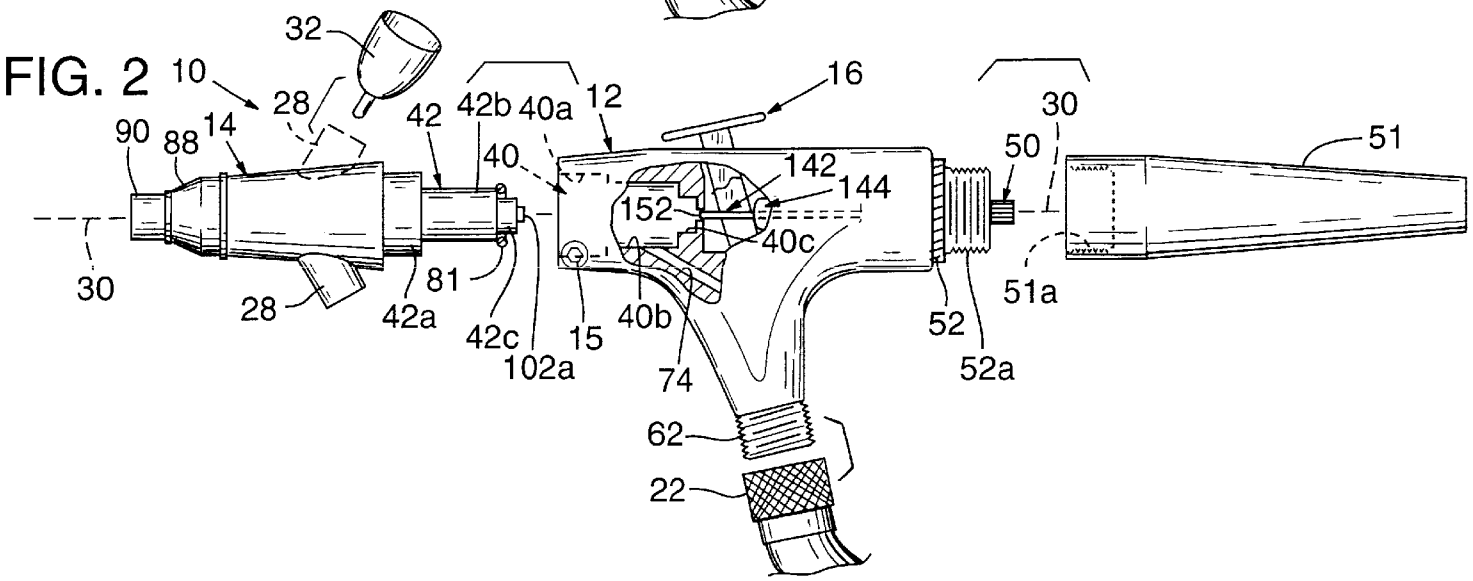
FIG. 2 is a side view of the air brush of FIG. 1 partially disassembled and illustrating a second mode of use and adjustment mechanism for trigger operation.

Air brush 10 also couples to a media source, in FIG. 1 illustrated as a jar 26 coupled to nozzle head 14 at a media port 28 thereof. As will be described more fully hereafter, air brush 10 is not limited in the type of media source employed. Media port 28 may be positioned by rotation to receive many types of media source. More particularly, air brush 10 defines a central longitudinal axis 30 and nozzle head 14, by virtue of its mounting arrangement relative to body 12, may be rotated about axis 30. Thus, media port 28 may be moved to a selected position about axis 30. For example, and as illustrated in FIG. 2, media port 28 may be moved to an upstanding position and receive a media cup 32. Due to its freedom in rotational orientation fully about axis 30 and relative to body 12, media port 28 may be coupled to a broad spectrum of media sources. Furthermore, rotation about axis 30 supports a broad spectrum of user selected device orientations when in use. For example, each user may have a preference for device orientation depending on the method of gripping the device when in use and the orientation of the surface to which media is applied. By providing a rotatable nozzle head 14, the user enjoys a broader range of selectable device orientations for a given media source employed.

Turning now to FIG. 2, showing nozzle head 14 separated from body 12, a stepped cylindric mounting site 40 of body 12 receives a matingly compatible stepped cylindric coupling structure 42 of head 14. Each of mounting site 40 and coupling structure 42 are coaxial relative to axis 30, thereby permitting rotation of nozzle head 14 about the axis 30. In this manner, nozzle head 14 may assume a selected rotational position about axis 30 and relative to body 12.

Nozzle head 14 is removed from body 12 by sliding coupling structure 42 along axis 30 and out of mounting site 40. In accordance with the present invention, no mechanical components span the gap between body 12 and nozzle head 14. As described more fully hereafter, mechanical interaction between body 12 and nozzle head 14 is by abutment between a needle of nozzle head 14 and an actuator shaft of body 12 responsive to trigger 16. Movement of the needle is in response to actuation of trigger 16, yet nozzle head 14 may be removed from body 12 by simply sliding coupling structure 42 out of mounting site 40. Also, body 12 delivers to mounting site 40 pressurized air in response to actuation of trigger 16. Nozzle head 14 receives the pressurized air at coupling structure 42 for use in developing the media spray 24.

FIG. 2 also illustrates an adjustment knob 50 at the rear of body 12. A rear handle 51, including internal threads 51*a* threadably mounts to a collar 52 threadably attached to body 12 just forward of knob 50, and including external threads 52*a* receiving handle 51. Handle 51 is a hollow structure receiving therein the knob 50 and providing appropriate support for air brush 10 when held in the hand of the operator thereof, i.e., handle 51 rests against the user's hand when held in the traditional fashion of an air brush. As described more fully hereafter, adjustment, i.e., turning about axis 30, of knob 50 establishes a selected position of actuator shaft 142 relative to trigger 16. This provides adjustment in trigger position relative to needle position. The user of air brush 10 may thereby establish a selected magnitude of media volume delivered in response to a given trigger 16 position.

Figures 3, 4:
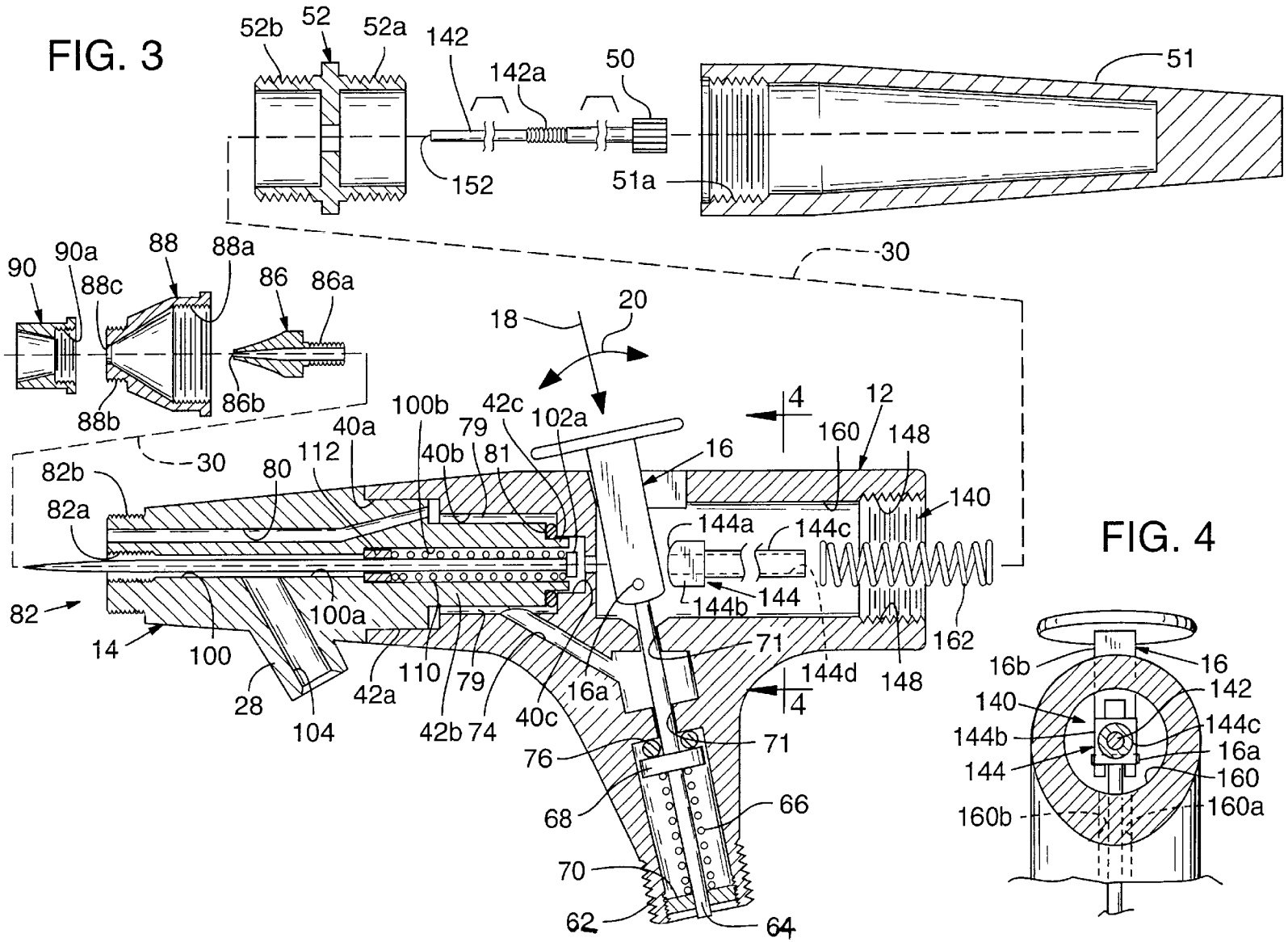
FIG. 3 is an exploded sectional side view illustrating individual components of the air brush of FIGS. 1 and 2.
FIG. 4 is a sectional view of the air brush taken along lines 4—4 of FIG. 3.

FIG. 3 is a sectional view detailing the internal components of air brush 10. FIG. 4 is a sectional view taken along lines 4—4 of FIG. 3 further illustrating internal components of air brush 10. In FIGS. 3 and 4, body 12 defines an air valve chamber 60 and a threaded hose mount site 62 whereby hose 22 attaches to body 12 and provides pressurized air to chamber 60.

Within chamber 60, a valve stem 64 resides. A spring 66 captured between a disk 68 of stem 64 and a lower shelf 70 of chamber 60 urges the valve stem 64 toward trigger 16. Stem 64 extends out of chamber 60 and supports a pivot pin 16*a*. The upward extending portion of stem 64 finds lateral support in the apertures 71 of body 12 through which stem 64 passes. As may be appreciated, stem 64 further enjoys longitudinal movement through apertures 71 of body 12.

As trigger 16 is depressed, stem 64 is driven downward, in the view of FIG. 3, to allow air to escape from chamber 60 and into air conduit 74 of body 12. In its normally biased position, disk 68 bears against an O-ring 76 and blocks a flow of pressurized air from entering conduit 74. As trigger 16 is depressed, however, stem 64 moves against spring 66 and disables the seal provided by O-ring 76 to allow escape of pressurized air from chamber 60 into conduit 74. Conduit 74 terminates at the mounting site 40 of body 12. In this manner, pressurized air may be selectively provided to mounting site 40 by depressing trigger 16. As explained more fully hereafter, pressurized air delivered to mounting site 40 is communicated to coupling structure 42 and then onto the nozzle of air brush 10.

Nozzle head 14 includes an air conduit 80 communicating pressurized air from the coupling structure 42 to a nozzle mounting site 82. Thus, pressurized air is selectively delivered to nozzle mounting site 82 by operation of trigger 16, i.e., by depressing trigger 16. The stepped cylindric shape of coupling structure 42 and mounting site 40 facilitates transmission of pressurized air from body 12 to nozzle head 14. In particular, mounting structure 42 includes a large diameter portion 42*a*, an intermediate diameter portion 42*b*, and a least diameter portion 42*c*. Similarly, mounting site 40 includes a largest diameter portion 40*a*, an intermediate diameter portion 40*b*, and a least diameter portion 40*c*. The diameters of portions 42*a* and 42*c* of mounting structure 42 correspond to the diameters of portions 40*a* and 40*c*, respectively, of mounting site 40. In this manner, nozzle head 14 is securely attached to body 12 by insertion of mounting structure 42 within mounting site 40, i.e., portion 42*a* being mechanically coupled to portion 40*a* and portion 42*c* being mechanically coupled to portion 40*c*. The diameter of portion 42*b*, however, is less than the diameter of portion 40*b*. Mounting structure 42 and mounting site 40, when joined, define an air transfer chamber 79 surrounding mounting structure 42. As may be appreciated, air transfer chamber 79 couples conduit 74 of body 12 and conduit 80 of nozzle head 14. It is suggested that an O-ring 81 be positioned on the portion 42*c* to establish an air seal preventing air flow into body 12. In this manner, air entering conduit 74 and delivered to mounting site 40 has but one path to follow, i.e., into conduit 80 for delivery to the nozzle mounting site 82.

A nozzle 86, including external threads 86*a*, threadably mounts to internal threads 82*a* of nozzle mounting site 82. A nozzle cap 88, including internal threads 88*a*, threadably mounts to external thread 82*b* of nozzle mounting site 82. A needle cap 90, including internal threads 90*a*, threadably mounts to external threads 88*b* of nozzle cap 88.

Nozzle head 14 defines a central bore 100 coaxial with axis 30 and terminating at the nozzle mounting site 82. Nozzle 86 extends bore 100, including restriction in diameter at the nozzle outlet 86*b*. Within bore 100 and nozzle 86 rests a needle 102 providing at its tip in conjunction with the restricted diameter of bore 100 a media valve operable by longitudinal movement of needle 102. Media port 28 defines a media conduit 104 communicating with a forward portion 100*a* of bore 100. The rear portion 100*b* of bore 100 is of slightly greater diameter and carries therein a spring 110 and an O-ring 112, each surrounding needle 102. O-ring 112 resides at a forward end of bore portion 100*b* and sealably receives the shaft of needle 102. Media introduced into forward bore portion 100*a* by way of media port 28 does not flow rearward into rear bore portion 100*b*. Needle 102 further includes an abutment 102*a* of greater diameter than the shaft of needle 102 and only slightly smaller in diameter than the rear bore portion 100*b*. Thus, spring 110 is captured between abutment 102*a* of needle 102 and O-ring 112 at the forward end of conduit portion 100*b*. Needle 102 is thereby spring biased away from nozzle 86, but may be urged toward nozzle 86 by, as will be explained more fully hereafter, an actuator shaft of body 12 driven forward into abutment 102*a* of needle 102.

With pressurized air delivered at the periphery of nozzle 86, i.e., at the outlet of conduit 80, and provided an escape route around nozzle 86 and out air outlet 88*c* of nozzle cap 88 will draw media from nozzle 86 so long as needle 102 allows flow of media therefrom. As previously described, needle 102 is positioned longitudinally by spring 110 and by engaging abutment 102*a* to move needle 102 toward nozzle 86.

Mechanical coupling between trigger 16 and needle 102, i.e., to establish a position for needle 102 relative to nozzle 86, is provided by an adjustment mechanism 140. Adjustment mechanism 140 includes the above noted adjustment knob 50. Adjustment mechanism 140 further includes an actuator shaft 142 extending from knob 50, a trigger engagement block 144, and the mounting collar 52. Mounting collar 52 includes rearward external threads 52*a* receiving handle 51 and forward external threads 52*b* threadably engaging internal threads 148 of body 12. Actuator shaft 142 carries at its rear end the adjustment knob 50, and at its forward end an actuator tip 152. Actuator shaft 142 lies coaxial relative to axis 30 and, under the influence of trigger 16, may be moved into engagement with abutment 102*a* of needle 102 whereby needle 102 may be positioned by operation of trigger 16. Along the length of actuator shaft 142 external threads 142*a* receive threadably thereon the trigger engagement block 144. More particularly, trigger engagement block 144 includes a forward portion having a rounded front face 144*a* and flats 144*b* on each side thereof. A trigger chamber 160 of body 12 slidably receives block 144, and includes surfaces 160*a* and 160*b* engaging flats 144*b* to restrict rotation of block 144 about axis 30. Block 144 further includes a rearward extending cylindric portion 144*c* including internal threads 144*d* threadably receiving threads 142*a* of shaft 142.

In this manner, rotation of knob 150 establishes a given longitudinal position of shaft 142 relative to block 144. Furthermore, the actuator tip 152 extends through and beyond block 144 and into the nozzle head mounting site 40 (see FIG. 2), the magnitude of extension being a function of mechanism 140. As seen in FIG. 4, trigger 16 includes downward extending legs 16*b* and 16*c*, providing an opening in the structure of trigger 16 for passage of shaft 142 therethrough. Also, collar 52 rests coaxially between block 144 and knob 50, and a spring 162 rests coaxially between collar 52 and block 144. The assembly of shaft 142, block 144, collar 52, and spring 162 threadably mount to body 12 by threading external threads 52*a* of collar 52 onto internal threads 148 of body 12. As may be appreciated, adjustment by rotation of knob 50 modifies the position of block 144 along axis 30. In this manner, the relative position between block 144 and trigger 16 may be selectively established.

Pivotal movement of trigger 16 rearward engages the rounded front face 144*a* of block 144 to drive block 144 and shaft 142 rearward. This movement allows needle 102 to move rearward under the influence of spring 110 and thereby open a flow of media through nozzle 86. By adjustment in knob 50, the magnitude of media delivered for a given position of trigger 16 is selectively established.

Thus, an improved air brush has been shown and described. The air brush of the present invention allows dismounting of a nozzle head from the air brush body with virtually no contamination of the body. Because the removable nozzle head 14 includes both a media port and a needle, no components of the air brush body 12 need be contaminated with media. By providing an inventory of nozzle heads 14, a user of air brush 10 can quickly switch between nozzle heads 14 with little or no interruption in work. Furthermore, due to the simplicity of structure and operation of the air brush of the present invention, servicing and maintenance is substantially minimized with resulting improvement in overall operation and life expectancy for the air brush 10. The air brush 10 provides versatility in receiving different types of media sources. Gravity fed media sources may be used by rotating the nozzle head 14 to provide an upstanding orientation for media port 28. Other media sources, e.g., jar 26, requiring suction of media therefrom may be employed by rotating nozzle head 14 to establish a downward orientation for media port 28. Side mounted media sources may also be used by appropriate rotational positioning of nozzle head 14.

The trigger arrangement of air brush 10 provides true double action, true single action or a combination of such trigger actions by a simple mechanical arrangement.

It will be appreciated that the present invention is not restricted to the particular embodiment that has been described and illustrated, and that variations may be made therein without departing from the scope of the invention as found in the appended claims and equivalents thereof.

What is claimed is:

1. An air brush comprising:

a body including a trigger assembly; and a nozzle head coupled to said body in rotatable relation thereto, said nozzle head being responsive to said trigger assembly to deliver a spray originating from a compressed air source and a media source when said compressed air source and said media source are coupled to said air brush, said nozzle head including a media port thereon, said air brush being operative to deliver said spray in at least a first angular position and a second angular position of said nozzle head, said first angular position and second angular position being distinct and established by rotation of said nozzle head relative to said body, said nozzle head being rotatable relative to said body to a selected orientation to receive at said media port a selected media source.

2. An air brush according to claim 1 wherein said media port couples selectively to one of a first and a second media source.

3. An air brush according to claim 2 wherein said first media source delivers media at least in part by force of gravity.

4. An air brush according to claim 2 wherein said second media source delivers media at least in part under influence of compressed air delivered by a compressed air source coupled to said air brush.

5. An air brush according to claim 2 wherein said first media source couples to said media port at said first angular position and said second media source couples to said media port at said second angular position.

6. An air brush according to claim 5 wherein said first angular position places said media port as an upper portion of said nozzle head.

7. An air brush according to claim 5 wherein said second angular position places said media port as a lower portion of said nozzle head.

8. An air brush according to claim 1 wherein said nozzle head includes a needle assembly including a needle having a butt-end and said trigger assembly includes an actuator engaging said needle butt-end.

9. An air brush according to claim 1 wherein said body includes a compressed air port and said rotatable relation is established by a mounting site allowing passage of compressed air from said air port to said nozzle head.

10. An air brush according to claim 1 wherein said air brush further includes means fixing said rotatable relation at a selected angular position.

11. An air brush comprising:

a body defining a first longitudinal axis and including a trigger assembly and a first mounting site formation; and a nozzle head defining a second longitudinal axis and including media port and a second mounting site formation, said first and second mounting site formations being matingly compatible to establish co-linear relation between said first longitudinal axis and said second longitudinal axis, rotatable relation between said nozzle head and said body, and respond to said trigger assembly by delivering a spray including media taken from said media port, said air brush being operative to deliver said spray in at least a first angular position and a second angular position of said nozzle head, said first angular position and second angular position being distinct and established by rotation of said nozzle head relative to said body, said first media source coupling to said media port with said rotatable relation at said first angular position and said second media source coupling to said media port at said second angular position.

12. An air brush according to claim 11 wherein said media port couples selectively to one of a first and a second media source.

13. An air brush according to claim 12 wherein said first media source delivers media at least in part by force of gravity.

14. An air brush according to claim 12 wherein said second media source delivers media at least in part under influence of compressed air delivered by a compressed air source coupled to said air brush.

15. An air brush according to claim 11 wherein said first angular position places said media port as an upper portion of said nozzle head.

16. An air brush according to claim 11 wherein said second angular position places said media port as a lower portion of said nozzle head.

17. An air brush according to claim 11 wherein said nozzle head includes a needle assembly including a needle having a butt-end and said trigger assembly includes an actuator engaging said needle butt-end.

18. An air brush according to claim 11 wherein said body includes a compressed air port and said rotatable relation is established by a mounting site allowing passage of compressed air from said air port to said nozzle head.

19. An air brush according to claim 11 wherein said air brush further includes means fixing said rotatable relation at a selected angular relation.

* * * * *